United States Patent [19]

Schultz

[11] Patent Number: 4,745,896

[45] Date of Patent: May 24, 1988

[54] UPPER CYLINDER AREA LUBRICATION SYSTEM

[76] Inventor: Robert A. Schultz, 907 Town & Country Blvd., Suite 202, Houston, Tex. 77024

[21] Appl. No.: 104,356

[22] Filed: Oct. 5, 1987

[51] Int. Cl.[4] ..... F01M 1/00

[52] U.S. Cl. ..... 123/196 M; 123/90.33

[58] Field of Search ..... 123/196 M, 196 R, 198 A, 123/198 C, 73 AD

[56] References Cited

U.S. PATENT DOCUMENTS

| | | | |
|---|---|---|---|
| 2,721,545 | 10/1955 | Harvey | 123/196 M |
| 2,722,210 | 11/1955 | Koonce | 123/156 M |
| 2,745,396 | 5/1956 | Harvey | 123/196 M |
| 2,865,362 | 12/1958 | Traughber | 123/196 M |
| 3,024,781 | 3/1962 | Frantsevitch | 123/196 M |
| 3,095,866 | 7/1963 | Dionne | 123/196 M |
| 3,115,874 | 12/1963 | Roberts | 123/196 M |
| 3,229,678 | 1/1966 | Anspach | 123/196 M |
| 3,827,417 | 8/1974 | Morita | 123/196 M |
| 4,059,086 | 11/1977 | Tsubouchi | 123/196 M |
| 4,703,728 | 11/1987 | Payne et al. | 123/198 A |

*Primary Examiner*—E. Rollins Cross

*Attorney, Agent, or Firm*—Vaden, Eickenroht Thompson & Boulware

[57] ABSTRACT

An upper cylinder area lubrication system is disclosed that dispenses a small amount of lubricant to the upper cylinder area of an internal combustion engine at regular intervals for a metered period of time. Typically, the lubricant is dispensed for one second every thirty minutes. An electric pump is used to draw the lubricant from the reservoir and apply it, preferably through a mixing chamber in the gasoline line located just before the gasoline is applied to the firing chambers. The control of the pump is via a solid-state timing device that separately sets the alternate on periods and the off periods.

11 Claims, 1 Drawing Sheet

FIG. 1
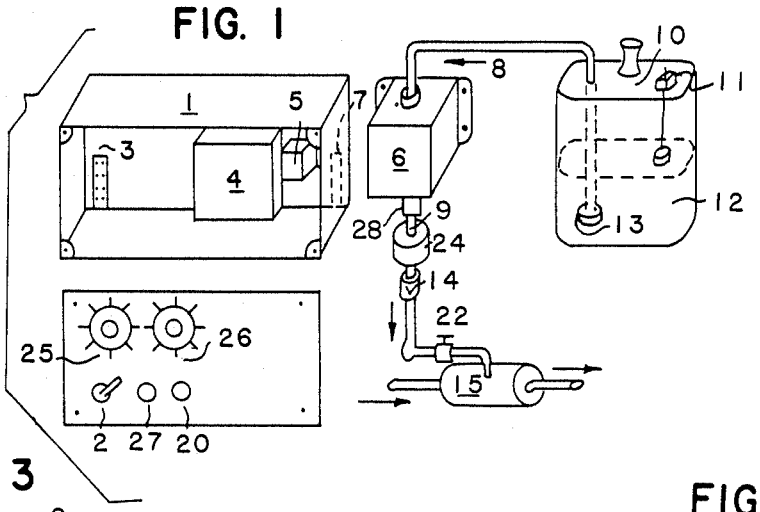
FIG. 3
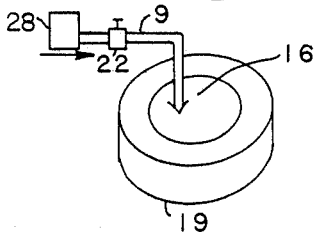
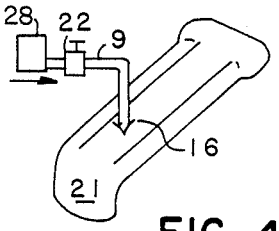
FIG. 4
FIG. 5
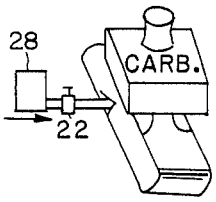
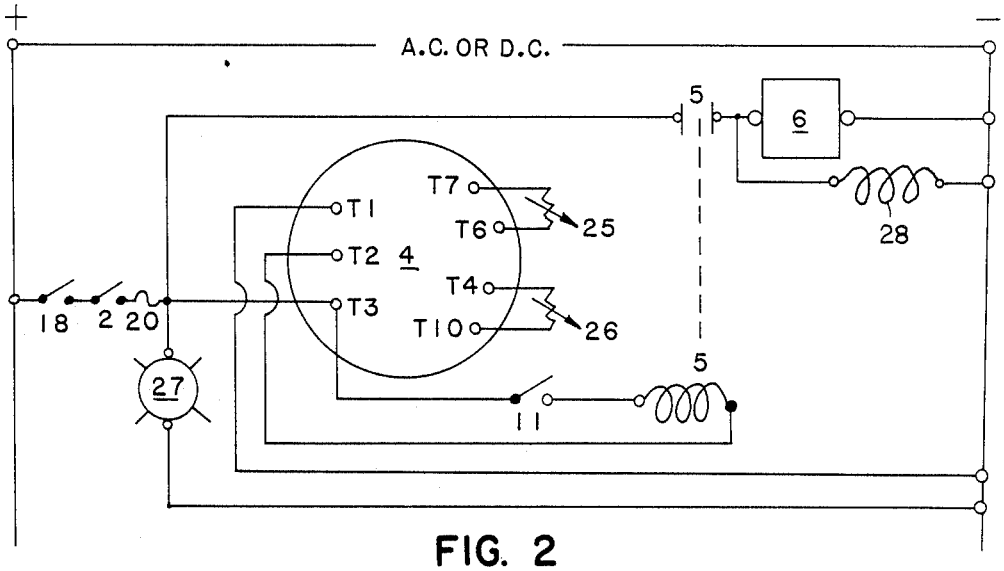
FIG. 2

UPPER CYLINDER AREA LUBRICATION SYSTEM

BACKGROUND OF THE INVENTION

1. Field of the Invention

This invention pertains to automatically lubricating the upper cylinder area of an internal combustion engine.

2. Description of the Prior Art

Internal combustion engines generally are inadequately lubricated in their upper cylinder areas. As a result, it is well-known that the cylinders and other parts of an internal combustion engine have a much shorter life span than the parts of a diesel engine. In addition, the parts operate less efficiently than they would if properly lubricated. With the advent of non-leaded gasolines, and especially high octane non-leaded gasolines, that are dryer burning than leaded gasolines, this problem of inadequate lubrication is exacerbated. Internal combustion engines that operate with methane fuel are even more notoriously poorly lubricated in their upper cylinder areas than are gasoline internal combustion engines because of the extremely dry burning conditions. The problem exists with internal combustion engines with fuel injectors as well as those without.

Attempts in the prior art to provide upper cylinder area lubrication include the system described in U.S. Pat. No. 3,115,874, which basically puts lubricant into the upper cylinder by drawing a vacuum on a lubricant reservoir and applying the lubricant through a valve in a manifold. Metering is provided through a "bi-metal" valve that determines the opening depending on the heat of the engine. The amount of lubricant applied is often entirely too much, however, since lubricant is constantly applied. As a result, the lubricant reservoir empties faster than is economical or practical and there is a gumming effect on the operating parts that are over-lubricated.

U.S Pat. No. 2,721,545 describes another system for lubricating the upper cylinder area of an internal combustion engine, this system using a fine spray or mist head to dispense the lubricant more uniformly over the parts than with a delivery scheme not including such a head. The lubricant is constantly applied, however, as with the '874 system. There is no known spray head that dispenses with a fine enough spray to be both efficient and non-wasteful. That is, the '545 scheme also dispenses much too much lubricant to be commercially acceptable.

Therefore, it is a feature of the present invention to provide an improved system for lubricating the upper cylinder area of an internal combustion engine that dispenses only the required amount of lubricant at intermittent intervals.

It is another feature of the present invention to provide an improved system for lubricating the upper cylinder area of an internal combustion engine that utilizes long-acting solid state timer means.

It is still another feature of the present invention to provide an improved system for lubricating the upper cylinder area of an internal combustion engine that utilizes a long-acting electric pump that does not impart a constant pressure condition on the operating engine parts, as with the '874 system.

SUMMARY OF THE INVENTION

The upper cylinder area lubrication system for an internal combustion engine in accordance with the present invention generally includes a conduit means, such as for example a mixing chamber where the gasoline or other fuel is mixed with lubricant, a lubricant supply means and timer means for automatically dispensing the lubricant in a predetermined manner. The lubricant supply means includes a reservoir for the lubricant and an electric pump that dispenses lubricant for typically a second or so when it is controlled on. More specifically, the electric pump is controlled on/off by timer means preferably comprising two timers, one for determining the duration of off periods (typically, of 30 minutes duration) and one for determining the duration of the on periods that occur between the off periods (again, typically one second periods). This intermittent dispensing scheme is sufficient to adequately lubricate the area without rapidly depleting the reservoir or creating gumming or other undersirable engine conditions when too much lubricant is applied. The parts are long-acting and do not interfere with the normal operation of the parts by imparting a constant pressure condition.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope as the invention may admit to other equally effective embodiments.

In the drawings:

FIG. 1 is a mechanical schematic representation of an upper cylinder area lubrication system in accordance with a preferred embodiment of the present invention.

FIG. 2 is an electrical schematic diagram of the electrical portion of the system shown in FIG. 1.

FIG. 3 is a mechanical schematic representation of a portion of the upper cylinder area lubrication system in accordance with an alternate preferred embodiment of the present invention.

FIG. 4 is a mechanical schematic representation of a portion of an upper cylinder area lubrication system in accordance with another alternate preferred embodiment of the present invention.

FIG. 5 is a mechanical schematic representation of a portion of an upper cylinder area lubrication system in accordance with yet another alternate preferred embodiment of the present invention.

DESCRIPTION OF PREFERRED EMBODIMENTS

Now referring to the drawings and first FIG. 1, a preferred embodiment of a fully automatic, electronic lubrication system in accordance with the present invention is shown in mechanical schematic representation. The system is designed to lubricate the upper cylinders, rings, piston chamber walls and valves of a gasoline or similarly fueled internal combustion engine every time the engine is turned on. Referring to the components illustrated in FIG. 1, an enclosure 1 is located underneath the hood or under the dashboard area of the cockpit of the vehicle serviced by the internal combustion engine to be lubricated and includes positive terminal strip 3 and negative terminal strip 7 for making electrical connections to the power system of the vehicle. Included in the enclosure is timing control 4 described more fully hereafter, that activates an electric relay 5. An isolation switch 2 is included for disabling the entire system, if desired, and is located mounted to cover 17 of the enclosure. Hence, switch 2 provides a convenient electrical disconnect for the unit from the electrical system of the vehicle.

Also included underneath the hood of the vehicle is lubricant reservoir 10 filled with an appropriate lubricant 12 for dispensing via tubing 8 to electric lubricant pump 6. A filter 13 maybe included at the intake to tubing 8, if desired. Also, if desired, a float switch 11 may be included for ensuring that the electric pump is deactivated when the lubricant level falls below a predetermined level. Float switches are commonly employed in the art and their manner of operation is well known.

Lubricant pump 6 is connected by way of tubing 9 to flow control valve 22. If desired, a pressure regulator 24 may be included in the tubing line between lubricant pump 6 and flow control valve 22. Also, a one way flow valve 14 may be included in this line to prevent any possible backup of flow to pump 6. Also, a normally closed electric flow valve 28 must be included to prevent vacuum pull when the system is off provided that pump 6 is the kind that does not shut off when not in use. In such case, valve 28 would not be required. Preferably, the solenoid coil of valve 28 is located in parallel across pump 6, as shown in FIG. 2 and physically the valve itself would be located just beneath pump 6, as shown in FIG. 1 or ahead of valve 22 in FIGS. 3, 4 and 5.

In FIG. 1, flow control valve, which may be a simple pitcock valve, allows the application of lubricant from pump 6 to enter a lubricant mixing chamber 15. Chamber 15 also receives the gasoline supply to the engine to be lubricated. Although theoretically the mixing chamber may be located anywhere in the gasoline supply line, it is most conveniently and efficiently located near the engine to be serviced.

The system is operated or controlled by two timers, which are most conveniently mounted on cover 17 of the enclosure. Timer 25 includes a potentiometer that may be set so that each time the timer operates, the coil of electric relay 5 is energized. The setting for this potentiometer allows relay energizing periods from approximately one half (½) second to 30 seconds. Timer 26 includes a potentiometer for establishing the off periods that occur between the on periods set by timer 25. The potentiometer of this timer allows the setting of the off periods over a range from about 15 minutes to one hour. Normally timer 25 is set to provide for one second "on" operation and timer 26 is set to provide 30 minute "off" operation, or less time if desired. In case the vehicle operates primarily in town, or in short time operation, the control box can be located near the driver so the off timer can be set to a shorter time (15 minutes is suggested for town driving) and then set back to 30 minutes for highway driving.

Also included and mounted in enclosure cover 17 are a fuse 20, a pilot light 27 to show the circuit is protected operational, and deactivating switch 2, previously described. In operation, each time the ignition switch is turned on to activate the engine, the system is enabled and the timers are started. For the duration of each off period, no lubrication is supplied to the engine. However, when the "off" period expires, the "on" period timer energizes the coil of relay 5, thereby closing its contacts and causing electric pump 6 to operate for a short period of time, typically one second. During the "on" period, electric pump 6 draws a measured quantity of lubricant from the reservoir and pressure pumps the lubricant into mixing chamber 15, located in the gasoline line as described above. The lubricant is mixed with the gasoline in chamber 15 precisely in a proportionately measured amount. Thereafter, the mixture is injected into the firing chambers of the engine. The dispensing head which is connected to the output tubing from the mixing chamber can conveniently include atomizer spray nozzles located in tapped holes in the intake air manifold. If desired, as shown in FIG. 3, the output from valve 22 can be applied directly into the engine air filter at the carburetor of the engine. In this case, a mixing chamber is not used. Alternatively as shown in FIG. 4, the lubricant can be pumped directly from valve 22 into conveniently located atomizer spray nozzles located in holes in the engine air intake manifold without going through a mixing chamber first. This is particularly applicable to engines with turbo or fuel injectors. Finally, as shown in FIG. 5, spray nozzles can be located directly in the engine intake manifold.

Now referring to FIG. 2, the wiring diagram for the vehicle upper cylinder area lubrication system is shown. The electrical power for the system may be either AC or DC. It will be seen that timing control device 4 is connected at terminal T3 through fuse 20, switch 2 and ignition switch 18 to one side of the power system. The opposite side is wired directly to terminal T1. Terminal T2 is wired to the coil of relay 5 through float switch 11, which is connected back to terminal T3. The potentiometers or variable resistors for the timers, are also shown in the FIG. 2 diagram. The potentiometer for timer 25 is shown connected to terminals T6 and T7 and the potentiometer for timer 26 is connected to terminals T4 and T10. The contacts for relay 5 are shown in series with electric pump 6. Electric pump 6 is connected directly to one side of the power wiring and through the switch contacts to the opposite side at the junction with fuse 20. A pilot light 27 is connected between the same points, as shown on the diagram.

A preferred timing device that includes both an "on" time delay and an "off" time delay is the TRS Repeat Cycle Timing Control marketed by Infitec Inc. of Syracuse, N.Y. This device is a fully solid state digital C/MO timing device and has a specification life of one hundred million operations minimum under full load. Although this timing means has proven effective, equivalent means are available. The electric pump employed as pump 6 can be TRW type no. 55469 or other fast response fuel pump.

The upper cylinder area lubrication system described above results in reduction of friction, heat and engine wear and thus increases engine operating life substantially. The operation is fully automatic. The only operator requirement is to maintain lubricant in the reservoir. The reservoir does not empty dramatically when the vehicle is in operation however, since it is not continuously being drained, as with reservoirs in some prior art systems.

The ability to adjust the time periods on and off enables a precise measured amount of lubricant to be pumped to the engine upper cylinder area to optimize the performance of the engine without fouling the spark plugs or adversely affecting engine operation in any way.

While particular embodiments have been shown and described, it will be understood that the invention is not limited thereto. Many modifications may be made and will be become apparent to those skilled in the art.

What is claimed is:

1. An upper cylinder area lubrication system for an internal combustion engine, comprising conduit means connected to the upper cylinder area of an internal combustion engine for introducing lubricant thereto, lubricant supply means including a reservoir for containing a lubricant suitable for introduction to the upper cylinder area of said internal combustion engine, and an electric pump connected to said reservoir and said conduit means, and timer means for automatically and alternately operating said pump on for relatively short periods of time and off for relatively long periods of time while the internal combustion engine is running.

2. An upper cylinder area lubrication system in accordance with claim 1, wherein said conduit means includes a mixer for receiving lubricant from said pump and gasoline from a gasoline feed line, the output from said mixer thereby being gasoline mixed with lubricant during said relatively short periods of time.

3. An upper cylinder area lubrication system in accordance with claim 1, wherein the internal combustion engine includes an air filter, and wherein said conduit means terminates in a spray head for introducing the lubricant to said air filter and directly above the carburetor air intake ports.

4. An upper cylinder area lubrication system in accordance with claim 1, wherein the internal combustion engine includes an air intake manifold, and wherein said conduit means terminates in a spray head for introducing the lubricant to said air intake manifold.

5. An upper cylinder area lubrication system in accordance with claim 1, wherein the internal combustion engine includes a carburetor and wherein said conduit means terminates in said carburetor.

6. An upper cylinder area lubrication system in accordance with claim 1, and including a pressure regulator between said pump and said conduit means.

7. An upper cylinder area lubrication system in accordance with claim 1, and including a sensor for monitoring the level of lubricant in said reservoir and turning off the lubrication system when the lubricant falls below a predetermined level.

8. An upper cylinder area lubrication system in accordance with claim 1, wherein said timer means operates said pump on for relatively short periods of time in the range between 0.5 seconds and 30 seconds and operates said pump off for relatively long periods of time in the range of about 30 minutes.

9. An upper cylinder area lubrication system in accordance with claim 8, wherein said timer means includes a first timer for timing the relatively short periods and a second timer for timing the relatively long periods.

10. An upper cylinder area lubrication system in accordance with claim 9, wherein said first timer and second timer are solid state devices.

11. An upper cylinder area lubrication system in accordance with claim 9, wherein said timer means includes an ignition switch for applying starting power to the internal combustion engine when turned on and disconnecting power from the internal combustion engine when turned off, said ignition switch connected to initiate said timer means when turned on and to disconnect said timer means when turned off.

* * * * *